US009683421B2

(12) United States Patent
Gadre et al.

(10) Patent No.: US 9,683,421 B2
(45) Date of Patent: Jun. 20, 2017

(54) WELLBORE SEALING ASSEMBLY WITH GROOVES FOR ENHANCED SEALING AND LOCKDOWN CAPACITY

(71) Applicant: Vetco Gray Inc., Houston, TX (US)

(72) Inventors: Aniruddha D. Gadre, Houston, TX (US); Joseph W. Pallini, Houston, TX (US)

(73) Assignee: VETCO GRAY INC., Houston, TX (US)

( * ) Notice: Subject to any disclaimer, the term of this patent is extended or adjusted under 35 U.S.C. 154(b) by 589 days.

(21) Appl. No.: 14/068,688

(22) Filed: Oct. 31, 2013

(65) Prior Publication Data

US 2015/0114622 A1 Apr. 30, 2015

(51) Int. Cl.
*E21B 33/04* (2006.01)
*E21B 33/043* (2006.01)

(52) U.S. Cl.
CPC ..... *E21B 33/0422* (2013.01); *E21B 33/04* (2013.01); *E21B 33/043* (2013.01)

(58) Field of Classification Search
CPC ..... E21B 33/0422; E21B 33/04; E21B 33/043
See application file for complete search history.

(56) References Cited

U.S. PATENT DOCUMENTS 4,641,708 A 2/1987 Wightman
4,665,979 A * 5/1987 Boehm, Jr. ..... E21B 33/04 166/208
4,932,472 A 6/1990 Boehm, Jr.
8,205,670 B2 6/2012 Nelson
2011/0316236 A1 12/2011 Gette et al.
2012/0085554 A1 4/2012 Gette et al.
2012/0247788 A1 10/2012 Ford et al.
2013/0146306 A1 6/2013 Yates et al.
2014/0131054 A1 5/2014 Raynal et al.

FOREIGN PATENT DOCUMENTS

GB 2462520 A 2/2010

OTHER PUBLICATIONS

PCT Search Report and Written Opinion issued in connection with corresponding PCT Application No. PCT/US2014/060825 on May 29, 2015.
U.S. Appl. No. 13/678,166, filed Nov. 15, 2012 entitled: Slotted Metal Seal.

* cited by examiner

*Primary Examiner* — Jennifer H Gay
*Assistant Examiner* — Steven MacDonald
(74) *Attorney, Agent, or Firm* — Hogan Lovells US LLP

(57) ABSTRACT

A wellbore system includes a sealing assembly for creating an annular seal between wellbore members. The sealing assembly includes a seal body having a u-shaped cross section, with elongate grooves formed on inner and outer walls thereof. A depth of the grooves varies along a length of the grooves to allow wickers to penetrate the groove by differing degrees when the walls are urged toward the wickers. The wickers can thus provide a high degree of both sealing and lockdown performance.

20 Claims, 5 Drawing Sheets

WELLBORE SEALING ASSEMBLY WITH GROOVES FOR ENHANCED SEALING AND LOCKDOWN CAPACITY

BACKGROUND OF THE INVENTION

1. Field of the Invention

The present invention relates in general to a sealing assembly operable in a wellbore for the recovery of hydrocarbons or other minerals. More specifically, the invention relates to an annular sealing assembly that includes a seal body with grooves formed therein, which are arranged to provide effective engagement with sealing surfaces of adjacent wellbore members.

2. Description of the Related Art

In an oil or gas well, a wellhead will generally be located on the ground surface, or on the sea floor for a subsea well. The wellhead is generally a tubular member having an axial bore through which other wellbore members may extend. For instance, a casing hanger often extends through the wellhead to support a casing string that extends below the wellhead into the well. A casing hanger is usually supported on at least one load shoulder within the axial bore such that an annular pocket is defined between the casing hanger and the wellhead. An annular sealing assembly may be provided within the annular pocket, e.g., to contain internal well pressure.

There are many types of annular sealing assemblies. Many of these sealing assemblies include sealing bodies constructed of rubber, other elastomeric materials, or metallic components. One type of seal body for creating a metal-to-metal seal has a u-shaped cross-section defined by inner and outer walls. The inner and outer walls are radially separated from one another and coupled to one another at their lower ends. An energizing ring is pressed downwardly into an annular clearance between the inner and outer walls to force the walls apart, and thereby force the walls into sealing engagement with adjacent wellbore members. The adjacent wellbore members may include, e.g., the wellhead and casing hanger.

Often the adjacent wellbore members include sealing surfaces for engaging the inner and/or outer walls, and often these sealing surfaces include wickers. Wickers are generally defined by adjacent ridges and valleys disposed in a generally parallel configuration. Wickers are generally distinguishable from threads, in which ridges and valleys may be disposed in helical pattern. When wickers are provided on an exterior sealing surface of the casing hanger and on an interior sealing surface of the wellhead, the inner wall of the seal body embeds into the wickers of the casing hanger and the outer wall of the seal body embeds into the wickers of the wellhead. The walls of the seal body are often constructed of a metal that is softer than the steel generally used for the wellbore and casing hanger to allow the wickers "bite" into the walls as the walls are embedded. The embedded walls effectuate a seal, and also perform a lockdown function by axially restraining the casing hanger within the wellhead.

The sealing and lockdown capacity of a sealing assembly can be affected by various factors. For instance, fluids such as drilling mud, water, or wellbore fluid trapped in the grooves of wickers can lead to hydraulic lock, and frustrate the embedding of the walls. It is desirable to provide a high degree of both sealing and lockdown performance even when the embedding of the walls is frustrated.

SUMMARY OF THE INVENTION

Described herein is an annular sealing assembly operable to provide a seal between wellbore members. The annular sealing assembly includes a seal body having a u-shaped cross section, with elongate grooves formed on inner and outer walls thereof. A depth of the grooves varies along a length of the grooves to allow wickers to penetrate the groove by differing degrees when the walls are urged toward the wickers. The wickers can thus provide a high degree of both sealing and lockdown performance.

According to one aspect of the invention, a wellbore system includes an outer wellbore member defining a longitudinal axis and including an axial bore extending therethrough. A first sealing surface is defined on the outer wellbore member within the axial bore. An inner wellbore member is disposed at least partially within the axial bore of the outer wellbore member. A second sealing surface is defined on an exterior of the inner wellbore member. A wicker profile is defined on at least one of the first and second sealing surfaces. A seal body is disposed within an annular pocket defined between the inner and outer wellbore members. The seal body is sealingly engaged with the first and second sealing surfaces such that the wicker profile is embedded into the seal body. The seal body has at least one elongate groove formed therein and engaged with the wicker profile. The at least one elongate groove has a variable depth along a length thereof such that a first portion of the at least one groove extends deeper into a wall of a seal body than an second portion of the at least one groove.

According to another aspect of the invention, a wellhead system includes an annular wellhead housing defining a longitudinal axis and having an axial bore, an annular casing hanger mounted in the axial bore, and a seal body disposed within an annular pocket defined between the annular wellhead housing and the annular casing hanger. A housing sealing surface is defined on the annular wellhead housing within the axial bore, and a hanger sealing surface is defined on the annular casing hanger. At least one elongate groove is defined in the seal body and is operable to be engaged with at least one of the housing sealing surface and hanger sealing surface. The at least one elongate groove exhibits a variable depth into the seal body along a length thereof.

According to another aspect of the invention, a wellbore system includes an outer wellbore member including an axial bore and defines a first sealing surface within the axial bore. An inner wellbore member is disposed at least partially within the outer wellbore member such that an annular pocket is defined between the inner and outer wellbore members. The inner wellbore member defines a second sealing surface thereon. An annular seal body is disposed within the annular pocket. The annular seal body includes an outer diameter surface defining an outer sealing surface thereon, and an inner diameter surface defining an inner sealing surface thereon. The outer sealing surface is operable to be sealingly engaged with the first sealing surface, and the inner sealing surface is operable to be sealingly engaged with the second sealing surface. At least one elongate groove is defined on at least one of the first sealing surface, the outer sealing surface, the inner sealing surface and the second sealing surface. The at least one elongate groove exhibits a variable depth along a length thereof.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
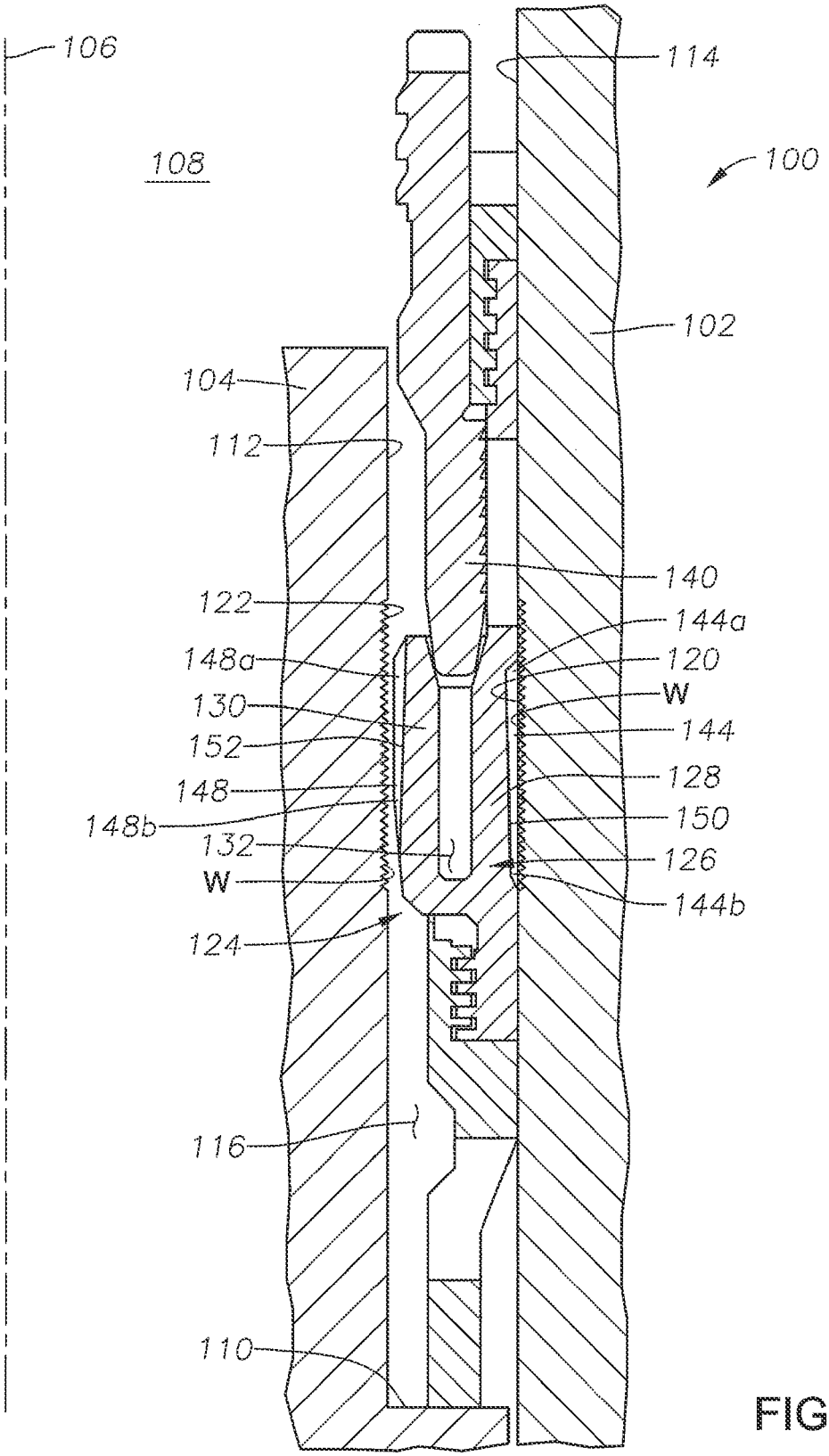
FIG. 1 is a partial, cross-sectional view of a wellbore system including an annular sealing assembly disposed between a wellhead housing member and casing hanger in accordance with one example embodiment of the present invention.

Referring to FIG. 1, a wellbore system 100 includes a first wellbore member such as wellhead housing 102 and a second wellbore member such as casing hanger 104. As one of skill in the art will appreciate, other wellbore members (not shown) such as tubing hangers, fluid conduits or other generally tubular members may be provided as the first and second wellbore members. In the illustrated embodiment, wellhead housing 102 is a conventional high-pressure housing operable in a subsea well (not shown). Wellhead housing 102 exhibits a tubular structure circumscribing casing hanger 104, and is disposed at an upper end of the subsea well. Wellhead housing 102 defines a longitudinal axis 106 and includes axial bore 108 extending through wellhead housing along longitudinal axis 106. Casing hanger 104 is a tubular member disposed at least partially within axial bore 108. An upper end of a casing string (not shown) that extends into the subsea well is coupled to a lower end (not shown) of casing hanger 104. Casing hanger 104 includes an upward facing shoulder 110 extending radially outward from an exterior wall 112 thereof. Exterior wall 112 is generally parallel and spaced radially inward from an interior wall 114 of wellhead housing 102. A clearance or annular pocket 116 is defined between exterior wall 112 of casing hanger 104 and interior wall 114 of wellhead housing 102.

A first sealing surface such as housing sealing surface 120 is located on interior wall 114 of wellhead housing 102. A second sealing surface such as hanger sealing surface 122 is located on exterior wall 112 of casing hanger 104 radially across annular pocket 116 from housing sealing surface 120. As one of skill in the art will appreciate, housing sealing surface 120 and hanger sealing surface 122 can exhibit any of a variety of surfaces textures such as a generally smooth surface, a texture that enhances friction while maintaining a seal, or wickers. The sealing surfaces 120, 122 depicted in FIG. 1 include wickers "W." Wickers are generally defined as a series of alternating, triangularly-shaped grooves and ridges arranged in parallel relation to one another. In some embodiments, the wickers "W" on sealing surfaces 120, 122 can have a depth of about 1/16 of an inch to about 1/4 of an inch, and are constructed of a relatively hard material such as a high-carbon steel that enable the wickers "W" to bite into a softer metal to form a seal as described in greater detail below. The housing sealing surface 120 and the hanger sealing surface 122 each define a generally straight wicker profile wherein a plurality of parallel, circumferentially extending ridges of the wicker profile extend to the same radial location.

Seal assembly 124 is disposed in annular pocket 116 between exterior wall 112 and interior wall 114, and is supported on upward facing shoulder 110. Seal assembly 124 is assembled entirely of metal components or a combination of metal and non-metal components. These components include a seal body 126, which exhibits a generally u-shaped cross section including outer leg or wall 128 and a parallel inner leg or wall 130. Inner wall 128 and outer wall 130 are connected to one another near lower ends thereof and separated from one another near upper ends thereof. Inner and outer walls 128, 130 are radially separated from one another defining an annular clearance 132 therebetween. Within the annular clearance 132, inner and outer walls 128, 130 exhibit generally smooth cylindrical surfaces, which are generally parallel with one other. An outer diameter surface of outer wall 128 includes outer sealing surface 134 (FIG. 2) for engaging housing sealing surface 120, and an inner diameter surface of inner wall 130 includes inner sealing surface 136 (FIG. 2) for engaging hanger sealing surface 122. In some embodiments, the inner and outer walls 128, 130 are constructed of a relatively soft material such as a low-carbon steel such that the wickers "W" on sealing surfaces 120, 122 can bite into the sealing surfaces 134, 136.

An energizing ring 140 is disposed above seal body 126. Energizing ring 140 is axially movable with respect to seal body 126 such that energizing ring can be moved into annular clearance 132 (see FIG. 3). The radial thickness of energizing ring 140 is greater than an initial radial dimension of annular clearance 132 such that movement of energizing ring into annular clearance serves to urge outer wall 128 and inner wall 130 radially apart from one another and into sealing engagement with housing sealing surface 120 and hanger sealing surface 122, respectively. The wickers "W" defined on of each sealing surface 114, 116 bite into outer sealing surface 134 and inner sealing surface 136, respectively.

An outer-diameter ("OD") groove 144 is defined on outer sealing surface 134 of seal body 126, and an inner diameter ("ID") groove 148 is defined on inner sealing surface 136. Grooves 144 and 148 each exhibit variable radial depth such that back walls 150, 152 of the grooves are tapered toward the annular clearance 132 in an upward direction. Thus, an upper portion 144*a* of groove 144 extends deeper into outer wall 128 than a lower portion 144*b* of groove 144. Similarly, an upper portion 148*a* of groove 148 extends deeper into inner wall 130 than a lower portion 148*b* of groove 148.

Figure 2:
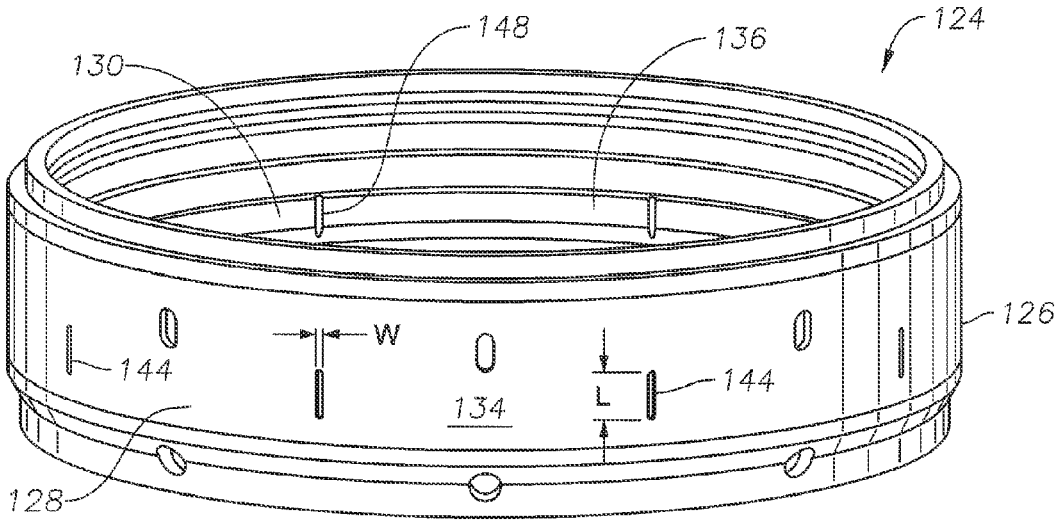
FIG. 2 is a perspective view of the annular sealing assembly of FIG. 1.

Referring now to FIG. 2, seal assembly 124 includes a plurality of OD grooves 144, which extend in an axial direction and are circumferentially spaced around outer wall 128 of seal body 126. Each OD groove 144 is generally vertically oriented such that a width "W" of each groove 144 is defined by the circumferential span of the groove 144, and a groove length "L" of each groove 144 is defined by the axial extent of the groove 144. Orientations other than vertical are contemplated as discussed below with reference to FIGS. 5-7. In some embodiments, the groove length "L" is greater than a portion of the housing sealing surface 120 that engages the OD grooves 144. In other embodiments, the groove length "L" is less than the portion of housing sealing surface 120 that engages the OD grooves 144. A plurality of ID grooves 148 are circumferentially spaced around inner leg 130. Each ID groove 148 is vertically oriented, although other orientations are also contemplated. As depicted in FIG. 2, grooves 144, 148 are open grooves devoid of any kind of a filler. However, in other embodiments, grooves 144, 148 may be filled with a soft material inlay as described in commonly owned, U.S. Patent Application Publication No. 2011/0316236, and U.S. patent application Ser. No. 13/678,166, both of which are hereby incorporated by reference herein in their entirety.

Figure 3:
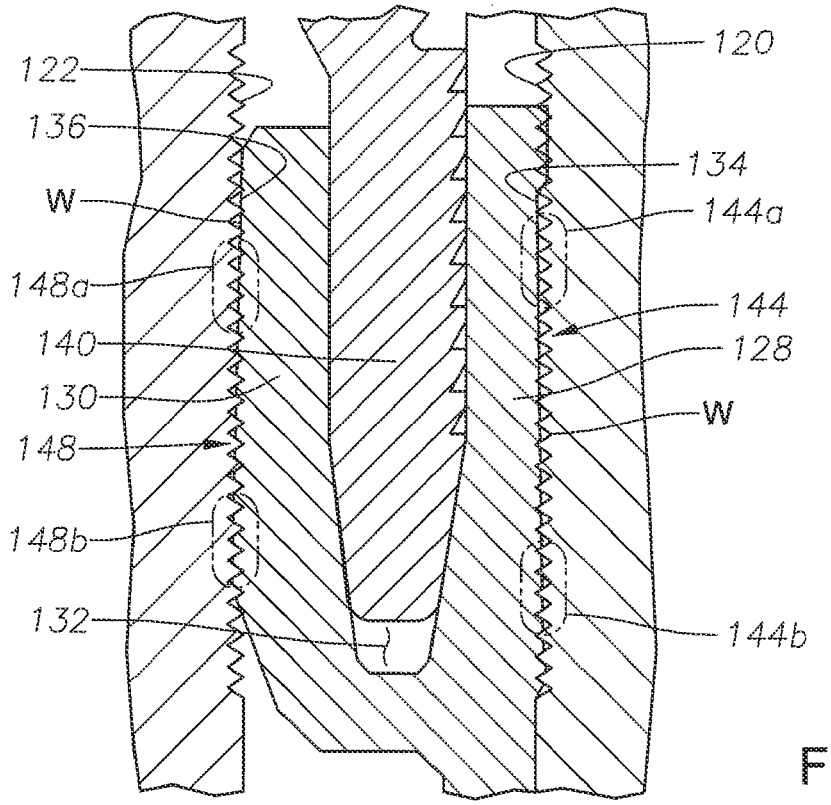
FIG. 3 is a partial, cross-sectional view of the wellbore system of FIG. 1 wherein the annular sealing assembly is arranged in an energized configuration with inner and outer walls of a seal body embedded in wickers on the wellhead housing member and casing hanger.

Referring now to FIG. 3, energizing ring 140 is moved into annular clearance 132 to urge outer wall 128 radially outward such that outer sealing surface 134 engages housing sealing surface 120, and to urge inner wall 130 radially inward such that inner sealing surface 136 engages hanger sealing surface 122. Since grooves 144, 148 are tapered, wickers "W" on the sealing surfaces 120, 122 bite into the respective sealing surfaces 134, 136 to a greater degree near the respective lower portions 144*b*, 148*b* than at the upper portions 148*a*, 148*a*. The deeper upper portions 144*a*, 148*a* of grooves 144, 148 allow for a relatively low level of hydraulic pressure build-up when fluids are trapped within wickers "W." This allows for deeper penetration of the wickers "W" into the sealing surfaces 134, 136 and provides for a relatively large lockdown capacity, e.g., the tendency for casing hanger 104 to resist axial movement with respect to wellhead housing 102. The more shallow lower portions 144*b*, 148*b* of grooves 144, 148 provide for a lower degree of wicker penetration into lower portions of sealing surfaces 134, 136. Where the wicker penetration is less than the depth of the wickers "W," multiple individual sealing interfaces are defined with individual wickers "W." This arrangement generally provides for a relatively high sealing capacity.

Figure 4:
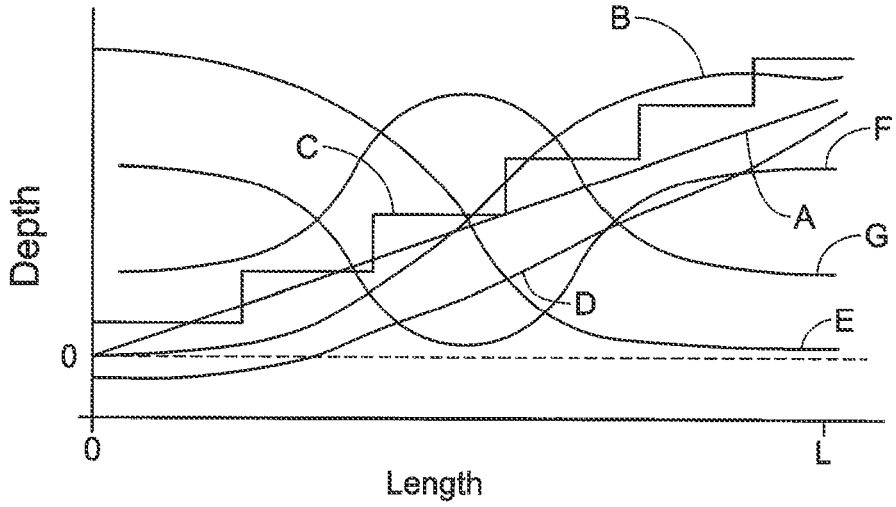
FIG. 4 is a chart illustrating various optional depth profiles for grooves defined on the inner outer walls of a seal body in accordance with various example embodiments of the present invention.

Referring now to FIG. 4, various depth profiles for grooves in accordance with the disclosure, e.g., grooves 144, 148 (FIG. 3) are illustrated. Profile-A is a generally linear profile transitioning from a depth of zero at a first end or lower end of grooves 144, 148 to a maximum desired depth at a second or upper end of grooves 144, 148. Profile-B is generally non-linear and follows an S-shaped curve along the length of grooves 144, 148, and Profile-C is a stepped profile increasing in discrete increments. Profile D is generally non-linear and transitions from a depth of less than zero at the first end to a maximum depth at the second end. A depth of less than zero indicates a radial protrusion extending from a sealing surface rather than a cavity formed into the sealing surface.

Other depth profiles are contemplated that do not necessarily increase along the entire length of grooves 144, 148. For example, Profile-E generally decreases from a maximum desired depth at first or lower ends of grooves 144, 148 to a minimum desired depth at second or upper ends of grooves 144, 148 Profile-F exhibits greater depth at both first and second ends than at a central portion of the grooves 144, 148 such that the depth generally decreases from the first and second ends of the grooves 144, 148 toward the central portion of the grooves 144, 148. Profile-G exhibits a greater depth at a central portion of the grooves 144, 148 than at first and second ends such that the depth generally increases from the first and second ends of the grooves 144, 148 toward the central portion of the grooves 144, 148. Other profiles such as, parabolic, sinusoidal or other repeating or non-repeating patterns are also contemplated.

Figure 5:
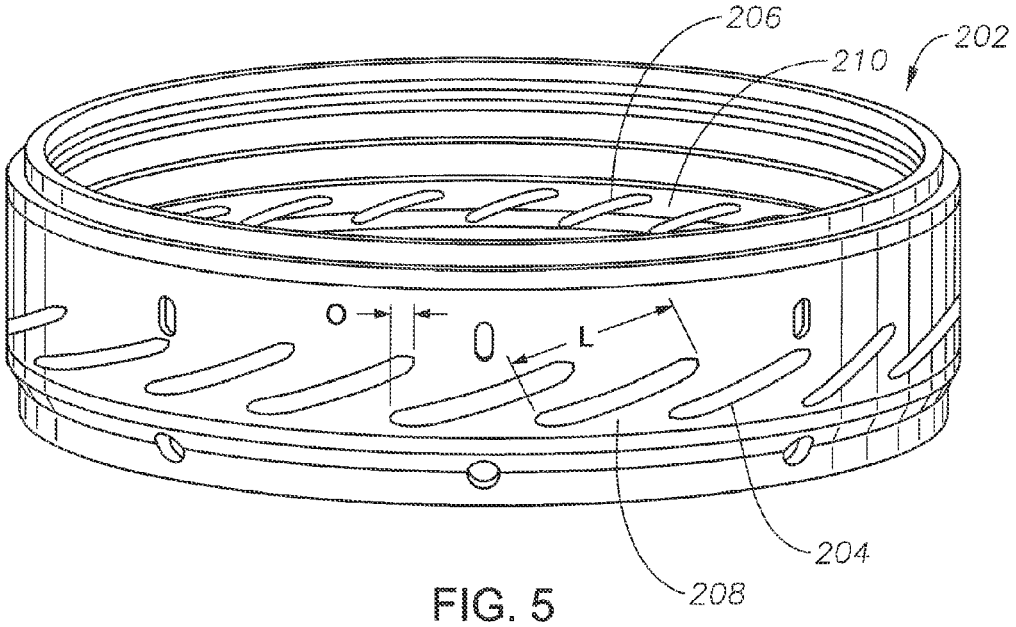
FIGS. 5, 6 and 7 are perspective views annular sealing assemblies illustrating alternate groove configurations in accordance with alternate example embodiments of the present invention.

Referring now to FIG. 5, a seal assembly 202 includes a plurality of OD grooves 204 and a plurality of ID grooves 206. Grooves 204, 206 are respectively defined on sealing surfaces 208, 210 and extend helically around a the seal assembly 202 such that length "L" of the grooves 204, 206 extends in both axial and circumferential directions about the seal assembly 202. The grooves 204, 206 can exhibit any of the depth profiles described above with reference to FIG. 4 along length "L" thereof. Grooves 204 are circumferentially spaced such that there is a circumferential overlap "O" between adjacent grooves 204. In other embodiments, helical grooves 204 can be circumferentially spaced to a greater extent such that there is no circumferential overlap between them.

Figure 6:
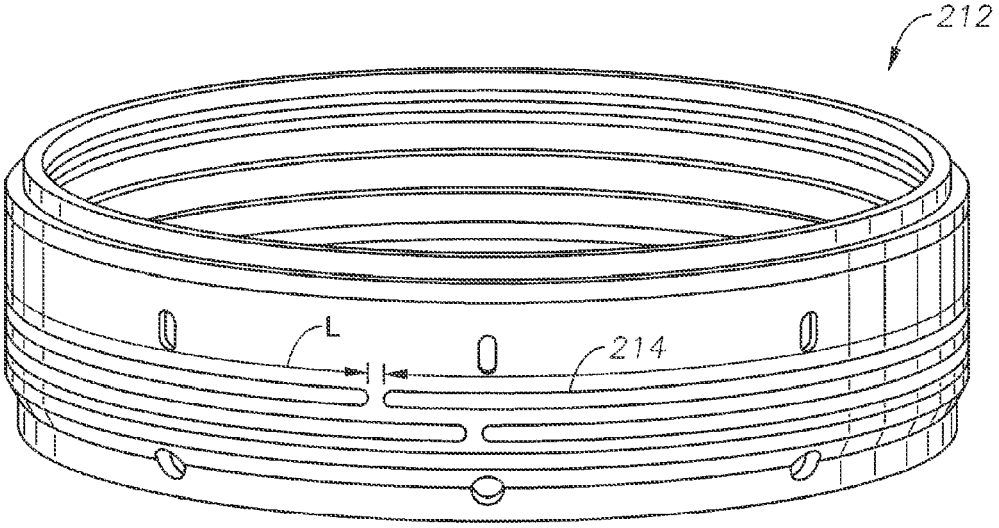
Figure 7:
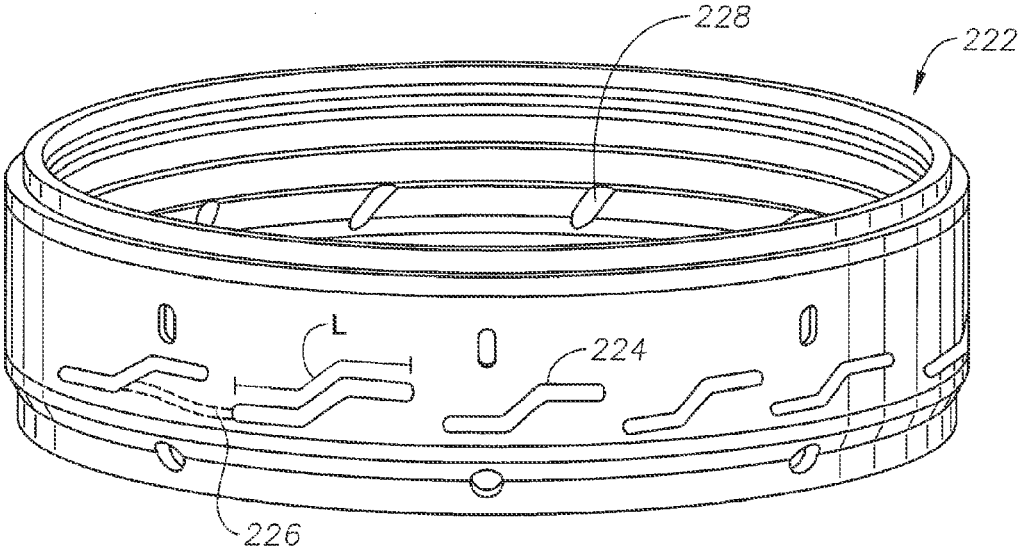

Referring now to FIGS. 6 and 7, additional groove profiles are illustrated. Seal assembly 212 (FIG. 6) includes a plurality if OD grooves 214 defined therearound. The OD grooves 214 are horizontally oriented and have a length "L" extending circumferentially around substantially the entire seal assembly 212. Seal assembly 222 (FIG. 7) includes a plurality OD grooves 224 extending along a curved length profile. The curved length "L" generally defines an s-shaped profile, and other non-linear length profiles are also contemplated. A bridge 226 is optionally provided between lower portions of adjacent OD grooves 224, fluidly coupling the adjacent OD grooves 224. The bridge 226 can be a slot extending between lower portions of adjacent OD grooves 224. A plurality of ID grooves 228 extend to an upper edge of an inner wall 230 such that an outlet is provided for any fluid within the grooves 228. Any of the grooves 214, 224, 228 can exhibit any of the depth profiles described above with reference to FIG. 4, or alternatively, the grooves 214, 224, 228 can have a constant depth along a respective length "L."

Figure 8:
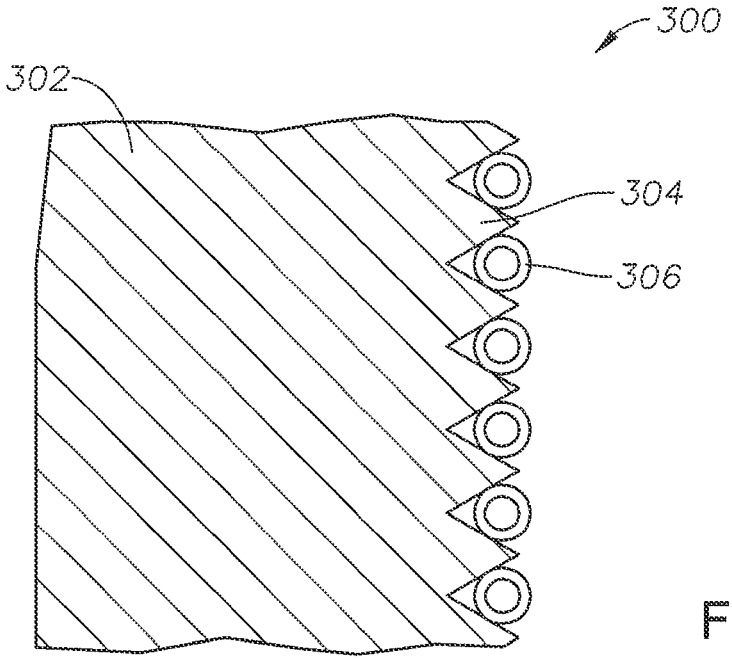
FIGS. 8 and 9 are schematic views illustrating alternate wicker profiles for engaging the seal body in accordance with alternate example embodiments of the present invention.
Figure 9:
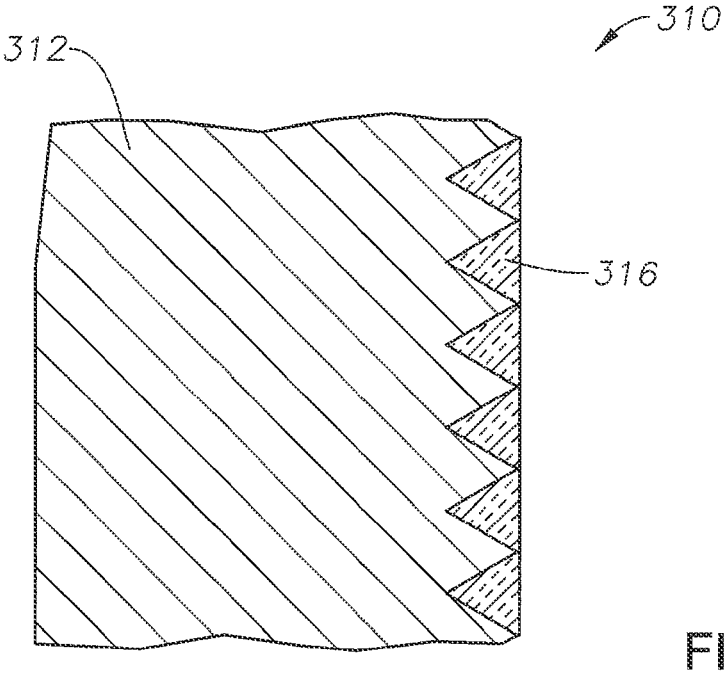

Referring now to FIGS. 8 and 9, alternate wicker profiles are illustrated for engaging a seal body. A wicker profile 300 (FIG. 8) is defined in wellbore member 302. The wicker profile 300 includes a plurality of circumferentially extending, parallel ridges 304. A plurality of collapsible tubes 306 is affixed to the wellbore member 302 between the ridges 304 by an adhesive, brazing, or other attachment mechanism. In the embodiment depicted in FIG. 8, collapsible tubes 306 have a diameter such that the collapsible tubes 306 extend generally to the same radial extent as parallel ridges 304. In some embodiments, the collapsible tubes 306 are constructed of a metallic or elastomeric material. The collapsible tubes 306 serve to discourage hydraulic lock by preventing liquids or incompressible fluids from entering the grooves between ridges 304. Similarly, wicker profile 310 (FIG. 9) defined on wellbore member 312 includes an engineered foam material 316 located between ridges 324 for discouraging liquids from entering the wicker profile 310. Wicker profile 310 thereby discourages hydraulic lock when a seal body, e.g., seal body 126, is engaged with the wicker profile 310.

In the embodiments described above, grooves with a variable depth, e.g., grooves 144 (FIG. 1) are defined on a seal body 126 while wickers "W" are defined on the wellbore members 102, 104 that engage the seal body 126. In other embodiments (not shown), wickers "W" may be defined on a seal body while grooves 144 are defined on wellbore members 102, 104.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A wellbore system comprising: an outer wellbore member defining a longitudinal axis and including an axial bore extending therethrough, and wherein a first sealing surface is defined on the outer wellbore member within the axial bore; an inner wellbore member disposed at least partially within the axial bore of the outer wellbore member, and wherein a second sealing surface is defined on an exterior of the inner wellbore member; a wicker profile defined on at least one of the first and second sealing surfaces; and a seal body disposed within an annular pocket defined between the inner and outer wellbore members, the seal body sealingly engaged with the first and second sealing surfaces such that the wicker profile is embedded into the seal body, the seal body having at least one elongate groove with a back wall formed therein and engaged with the wicker profile, the at least one groove having a longitudinal axis, and a variable depth along a length thereof in a direction substantially parallel with the longitudinal axis such that a first portion of the at least one groove extends deeper into a wall of a seal body than a second portion of the at least one groove.

2. The wellbore system of claim 1, wherein the at least one groove extends in an axial direction and wherein the first portion of the at least one groove is an upper portion of the at least one groove and the second portion is a lower portion of the at least one groove.

3. The wellbore system of claim 2, wherein the at least one groove is tapered along a generally linear depth profile between the upper portion and the lower portion.

4. The wellbore system of claim 3, wherein the wicker profile is generally straight in an axial direction such that each of a plurality of circumferentially extending, parallel ridges defining the wicker profile extends to the same radial location.

5. The wellbore system of claim 1, wherein the at least one groove is helically arranged such that the length of the at least one groove extends in both axial and circumferential directions about the seal body.

6. The wellbore system of claim 5, wherein the at least one groove comprises a plurality of grooves, and wherein each groove of the plurality of grooves is circumferentially spaced from adjacent grooves.

7. The wellbore system of claim 6, wherein each groove of the plurality of grooves defines a circumferential overlap with adjacent grooves.

8. The wellbore system of claim 1, wherein the wicker profile defines a first wicker profile on the first sealing surface, and wherein a second wicker profile is defined on the second sealing surface, and wherein the first wicker profile and the second wicker profile are both embedded into the seal body.

9. The wellbore system of claim 8, wherein the at least one groove includes at least one outer diameter groove defined on an outer diameter surface of the seal body and at least one inner diameter groove defined on an inner diameter surface of the seal body, and wherein the first wicker profile is embedded into the outer diameter surface of the seal body and the second wicker profile is embedded into the inner diameter surface of the seal body.

10. The wellbore system of claim 1, wherein the sealing body exhibits a generally u-shaped cross section including outer wall and a parallel inner wall, and wherein the outer wall and inner wall are operable to be urged in a radial direction by movement of an energizing ring into an annular clearance between the outer wall and inner wall.

11. A wellhead system comprising: an annular wellhead housing defining a longitudinal axis and including an axial bore; an annular casing hanger mounted in the axial bore; a seal body disposed within an annular pocket defined between the annular wellhead housing and the annular casing hanger; a housing sealing surface defined on the annular wellhead housing within the axial bore; a hanger sealing surface defined on the annular casing hanger; and at least one elongate groove with a longitudinal axis and a back wall defined in the seal body and operable to be engaged with at least one of the housing sealing surface and hanger sealing surface, the at least one elongate groove exhibiting a variable depth into the seal body along a length thereof in a direction substantially parallel with the longitudinal axis.

12. The wellhead system of claim 11, wherein the at least one elongate groove is tapered along a generally non-linear depth profile.

13. The wellhead system of claim 12, wherein the depth transitions from a depth of less than zero at a first end of the at least one elongate groove to a maximum depth at a second end of the at least one elongate groove.

14. The wellhead system of claim 11, wherein the depth generally increases from both a first end and a second end of the at least one elongate groove toward a central portion of the at least one elongate groove.

15. The wellhead system of claim 11, wherein the depth generally decreases from both a first end and a second end of the at least one elongate groove toward a central portion of the at least one elongate groove.

16. The wellhead system of claim 11, wherein the at least one elongate groove exhibits a stepped profile such that the depth increases between a first end of the at least one elongate groove to a second end of the at least one elongate groove in discrete increments.

17. The wellhead system of claim 11, wherein the length of the at least one elongate groove extends along curved length profile.

18. The wellhead system of claim 11, wherein the at least one elongate groove includes a plurality of circumferentially spaced grooves, and wherein adjacent ones of the circumferentially spaced grooves are in fluid communication with one another by a bridge defined in the seal body.

19. The wellhead system of claim 11, wherein at least one of the housing sealing surface and the hanger sealing surface defines a wicker profile thereon including a plurality of parallel ridges and a plurality of collapsible tubes disposed between the parallel ridges.

20. A wellbore system, comprising: an outer wellbore member including an axial bore and defining a first sealing surface within the axial bore; an inner wellbore member disposed at least partially within the outer wellbore member such that an annular pocket is defined between the inner and outer wellbore members, the inner wellbore member defining a second sealing surface thereon; an annular seal body disposed within the annular pocket, the annular seal body including an outer diameter surface defining an outer sealing surface thereon and an inner diameter surface defining an inner sealing surface thereon, the outer sealing surface operable to be sealingly engaged with the first sealing surface, and the inner sealing surface operable to be sealingly engaged with the second sealing surface; and at least one elongate groove with a longitudinal axis and a back wall defined on at least one of the first sealing surface, the outer sealing surface, the inner sealing surface and the second sealing surface, the at least one elongate groove exhibiting a variable depth along a length thereof in a direction substantially parallel with the longitudinal axis.

* * * * *